US006371312B1

(12) United States Patent
Tsuchida

(10) Patent No.: US 6,371,312 B1
(45) Date of Patent: Apr. 16, 2002

(54) KNIFE BLOCK

(75) Inventor: Minoru Tsuchida, Chiba-ken (JP)

(73) Assignee: Master Cutlery Corporation, Chiba-Ken (JP)

( * ) Notice: Subject to any disclaimer, the term of this patent is extended or adjusted under 35 U.S.C. 154(b) by 0 days.

(21) Appl. No.: 09/597,418

(22) Filed: Jun. 19, 2000

(51) Int. Cl.[7] ..... A47F 7/00

(52) U.S. Cl. ..... 211/70.7; 248/37.3; 30/138; D7/637

(58) Field of Search ..... 211/70.7; 248/37.3, 248/37.6; D7/637; 30/138

(56) References Cited

U.S. PATENT DOCUMENTS 1,742,102 A * 12/1929 Seagles
D271,171 S * 11/1983 Kinkade
4,509,651 A * 4/1985 Prindle ..... 211/70.7
4,693,439 A * 9/1987 Hahn ..... 248/37.6
4,866,845 A 9/1989 McEvily
D382,773 S * 8/1997 Cohen et al. ..... D7/637
D382,774 S * 8/1997 Cohen et al. ..... D7/637
6,079,108 A * 6/2000 Lin ..... 211/70.7 X

* cited by examiner

*Primary Examiner*—Robert W. Gibson, Jr.
(74) *Attorney, Agent, or Firm*—Sughrue Mion, PLLC

(57) ABSTRACT

A knife block provided with a blade guide having a clearance through which a blade part of knives is inserted to lead the blade part in a predetermined direction, a holder part to retain the knives engaging the grip part of the knives, a cover part surrounding the circumference of a blade part by forming a holder part on an upper aperture and a base plate on which the cover part uprightly stands with inclination is offered according to the present invention.

1 Claim, 6 Drawing Sheets

KNIFE BLOCK

BACKGROUND OF THE INVENTION

1. Field of the Invention

The present invention relates to a knife block to hold a plurality of cooking knives and a file to grind such cooking knives (hereinafter referred to only as knives).

2. Prior Art

Kitchens of houses or restaurants are provided with knives for cooking.

In some cases, the kitchen knife housing may be found inside the partition door under the kitchen scullery. In other cases, a plurality of knives are housed in a kitchen drawer. In any case, the knives are taken out when they are demanded for cooking.

However, it can be inconvenient to access knives. For instance, when quick cooking is demanded, it is not easy to take out knives from inside of the partition door. In particular, in the case when several different kinds of knives are desired when cooking, it is an annoyance to take out the knives from, or put them back, to inside of the partition door after washing the knives with water and wiping them off. For this reason, most people lay the knives temporarily on the scullery after they use the knives. Knives placed on the scullery are very dangerous and unsanitary. The present invention has been made with the foregoing background in mind. The aim of the present invention is to offer a knife block of a simple structure and yet convenient for handling knives.

SUMMARY OF THE INVENTION

The present invention offers a knife block comprising a plurality of knife guides provided with slots through which each knife is inserted downward, respectively. Each slot is provided with narrow gap to guide the knife to slide properly vertically downward. The knife block of the present invention further comprises a cylindrical cover plate made of stainless steel surrounding the inserted knives. There is a lid on the upper end of the cylindrical cover. The lid is provided with a plurality of slots. Said cylindrical cover stands in an upward direction with a predetermined pertinent inclination.

DETAILED EXPLANATION OF THE PREFERRED EMBODIMENTS OF THE INVENTION

The present invention is explained with reference to the accompanied drawings.

Figure 1:
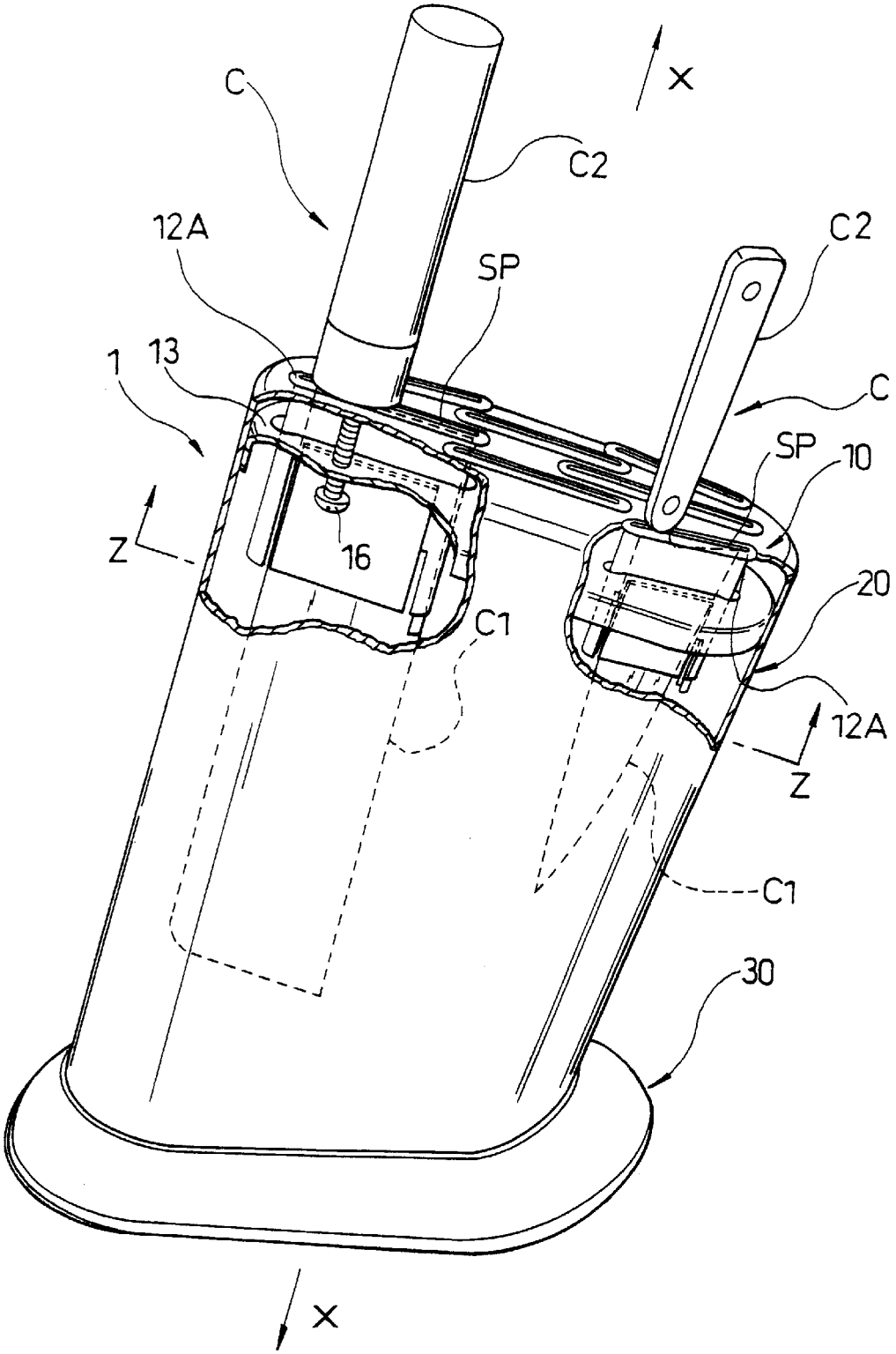
FIG. 1 is a general perspective view demonstrating a broken out section of a knife block according to the present invention.

In FIG. 1, reference numeral 1 indicates a knife block. The knife block 1 comprises a holder part 10 to retain the knives C, a cover part 20 surrounding a blade part C1 of the knives C, a base plate 30 to secure the cover part 20 upwardly with a predetermined pertinent inclination. The cover part 20 presents a cylindrical member and it has the holder part 10 on the upper aperture. The lower aperture of the cover part 20 is detachably secured with respect to the base plate 30.

Figure 2:
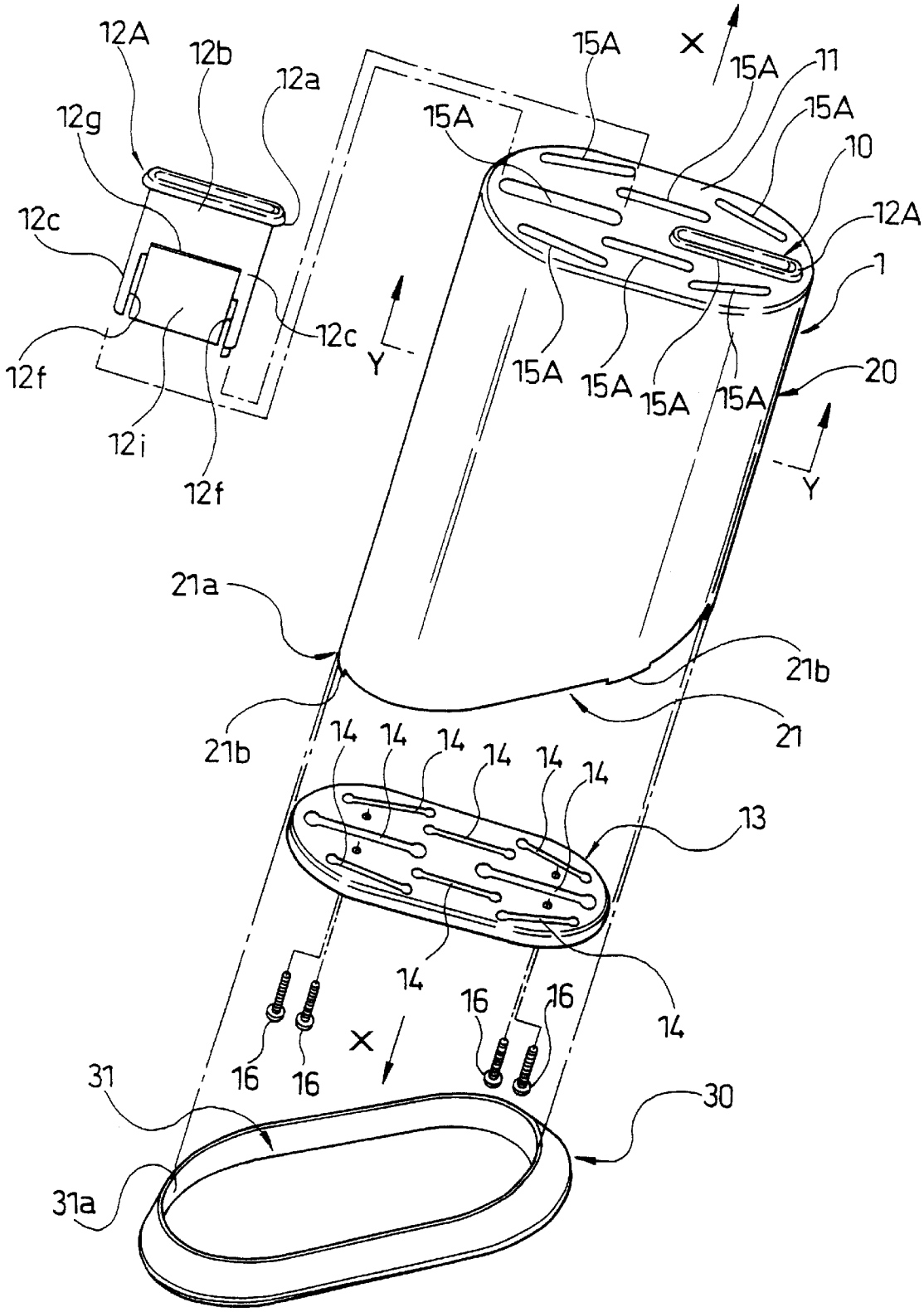
FIG. 2 is an analytical perspective view indicating the knife block according to the present invention.
Figure 3A:
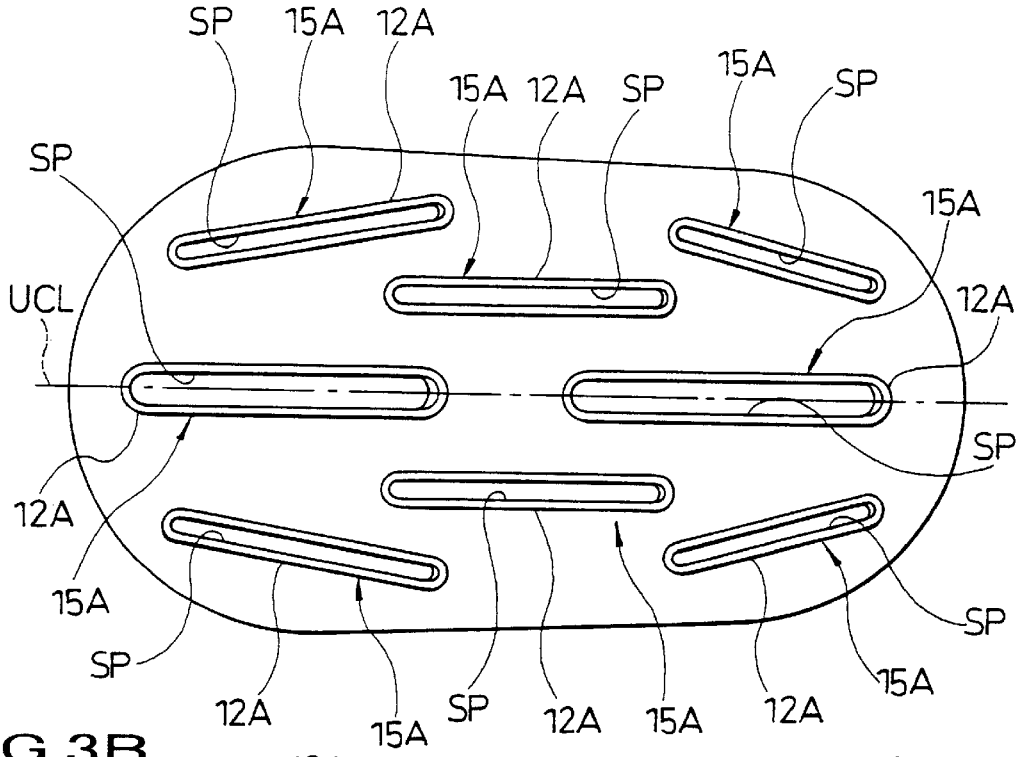
FIG. 3A indicates an aspect of the embodiments of the present invention along the direction of the arrow marked X in FIG. 1.

In FIG. 2, the upper aperture of the cover part 20 is fixedly covered with a cap part 11. There are provided a plurality of insert holes 15A, on the cap part 11. In the first aspect of the embodiments of the present invention, there are eight insert holes as shown in FIG. 2. Configuration of the insert holes is determined depending upon the configuration of the blade part C1 of the knives C to be retained. In the first aspect of the embodiments, as shown in FIG. 3A, the insert holes 15A, of three different dimensions are provided in contrast with each other with respect to the center line UCL. A plurality of blade guides 12A, are fixedly fitted to said insert holes 15A, respectively. Meanwhile, there is provided with a support plate 13 under the holder part 10 as shown in FIG. 1. In the support plate 13, there are provided with a plurality of support holes 14, which correspond to said insert holes 15A. The blade guides 12A are fixed with respect to each of said support holes 14.

The relation between the blade guide 12A and the cap part 11, also between the blade guide 12A and the support plate 13, as well as the structure of the blade guide 12A are explained with reference to FIG. 2 and FIG. 4. A plurality of the insert hole 15A, the blade guide 12A and the support hole 14 are offered in the present invention. Each of the structures of the insert hole 15A, the blade guide 12A and the support hole 14 are identical with each other. For this reason, one example is explained hereinafter.

Figure 4A:
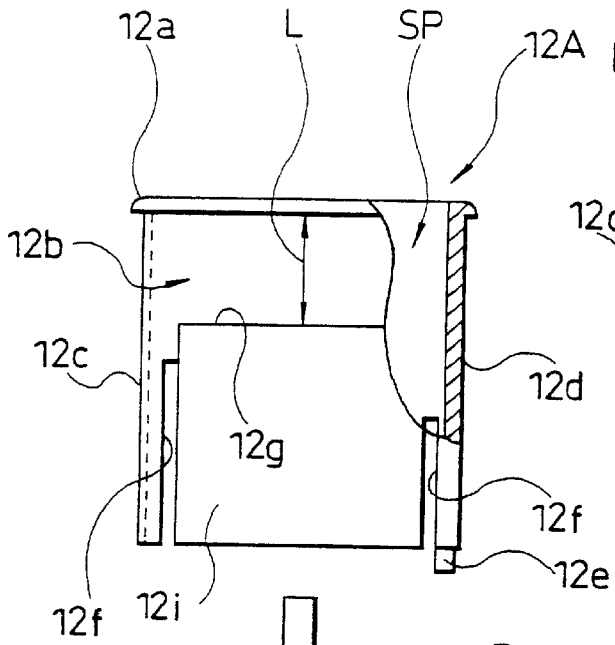
FIG. 4A is a side view of a knife guide according to the present invention.
Figure 4B:
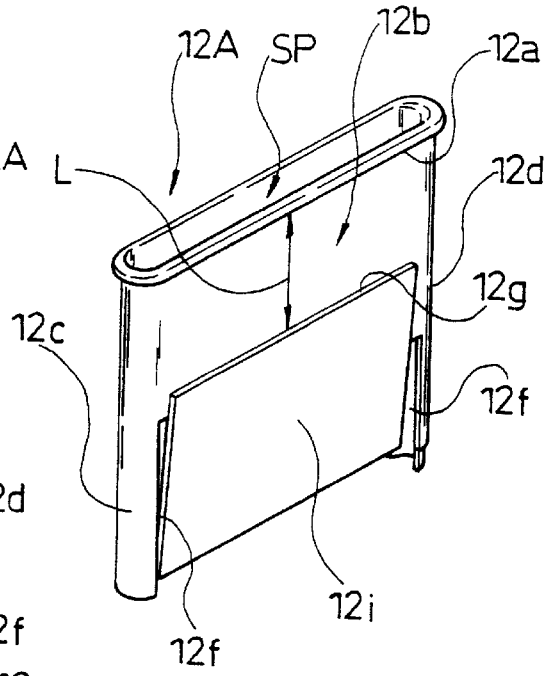
FIG. 4B is a perspective view of a knife guide according to the present invention.
Figure 4C:
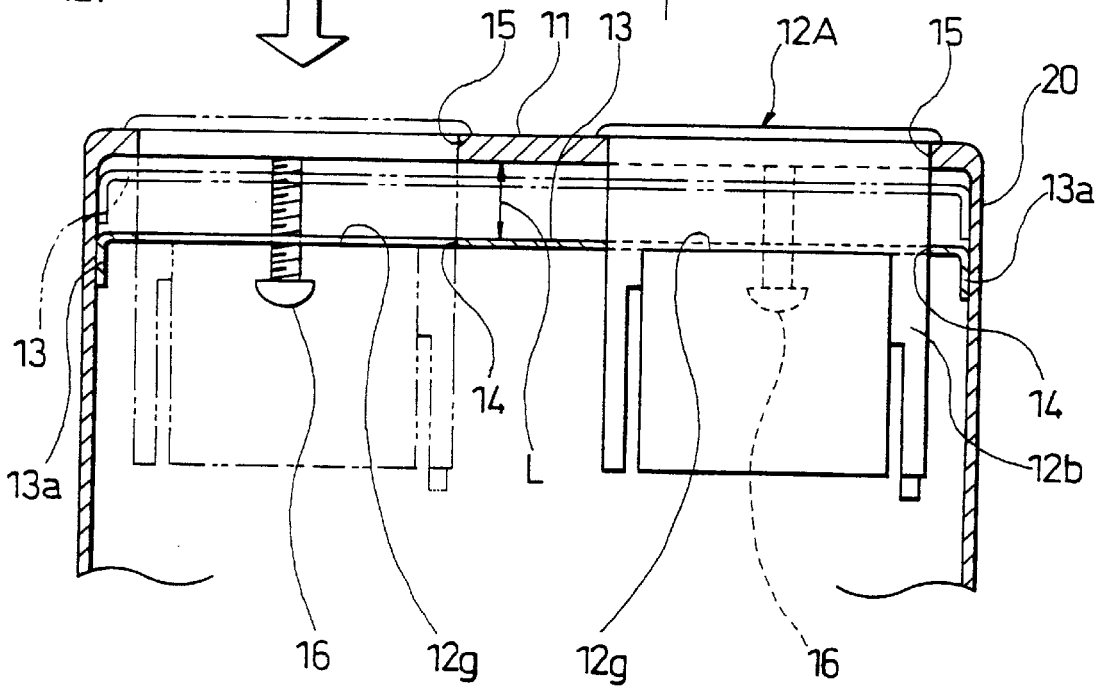
FIG. 4C indicates the Y—Y cross-section in FIG. 2.

FIG. 4A is a side section of the blade guide 12A. FIG. 4B is a perspective view of said blade guide 12A. FIG. 4C is a Y—Y cross section in FIG. 2. The blade guide 12A, as shown in FIGS. 4A and 4B, presents a form of vertically divided guide body 12*b* and each of the two divided guide body 12*b* is integrated together through the left and right circumferential edges 12*c*, 12*d*. For this reason, the guide body 12*b* has a clearance SP through which the blade part C1 of the knives C is inserted.

The guide body 12*b* is made of plastic and offers plasticity. It retains the blade part C1 of the knives C inserted into such clearance SP. One circumferential edge 12*d* is formed thicker comparing with the thickness of the other circumferential edge 12*c*. The blade part C1 slidably connects with respect to the circumferential edge 12*d*. There is provided with a protrusion 12*e* at the lower end of the circumferential edge 12*d*. A user can judge the slidable connecting side of the blade C1 quite easily.

A flange-like engagement part 12*a* is formed on the aperture side of the guide body 12*b*. There is provided a flat tapered plate 12*i* at one side of the guide body 12*b*. The other side of the guide body 12*b* is also provided with the other flat tapered plate 12*i*. FIG. 2 and FIG. 4 indicate one of the surfaces of the guide body 12*b*. The flat tapered plate 12*i* and 12*i* are formed tapered in upright direction and gradually expanded toward the blade guide 12A. One slit 12*f* is formed between the tapered part 12*i* and the circumferential edge 12*c*. The other slit 12*f* is formed between the flat tapered plate 12*i* and the circumferential edge 12*d*. Upper end parts 12*g* are formed on the upper end of the flat tapered plates 12*i*. (FIG. 2 and FIG. 4 show one face only.) There is predetermined distance L between the upper end parts 12*g*, and the engagement part 12*a* (refer to FIG. 4A).

The blade guide 12A is, as shown in FIG. 2, fitted into the insert hole 15A, and the engagement part 12*a* of said blade guide 12A is engaged with the cap part 11. Meanwhile, the lower end of the blade guide 12A is fitted into the support hole 14 of the support plate 13. The support hole 14 interferes with the flat tapered plates 12*i* gradually expanding upwardly. Then, each of the flat tapered plates 12*i* moves toward the direction to reduce the clearance SP due to actuation of slits 12*f* and the support hole 14 goes up further. When the support hole 14 goes over beyond the upper end parts 12*g*, the flat tapered plates 12*i* are released interference by the support hole 14 and expands due to elastic action of the guide body 12*b*. A position of the support plate 13 when the support hole 14 goes over the upper end parts 12*g* is indicated by the imaginary line in FIG. 4C (hereinafter the position is referred to as a preparation position).

The circumference of the support plate 13 is folded downwardly and forms a connecting part 13*a*. In short, when the support plate 13 is housed within the cover part 20, the connecting part 13*a* slides the inner surface to lead the support plate 13 to move (refer to FIG. 4C). For this reason, stability of the support plate 13 is improved. The support plate 13 is prevented from being inclined in the cover part 20.

A bolt 16 passes through the support plate 13. When the blade guide 12A is reached to said preparation position, the bolt is screwed in. The tip end of the bolt 16 connects the inner surface of the cap part 11 and the support plate 13 is pressed downward. The support plate 13 is reached to the upper end parts 12*g*. 12*g* of the blade guide 12A (refer to the actual line in FIG. 4A). The support plate 13 is engaged with the upper end parts 12*g* and supported. The thickness of the cap part 11 is larger than the thickness of the cover part 20. The cap part 11 is endurable against the pressed bolt 16.

Figure 5:
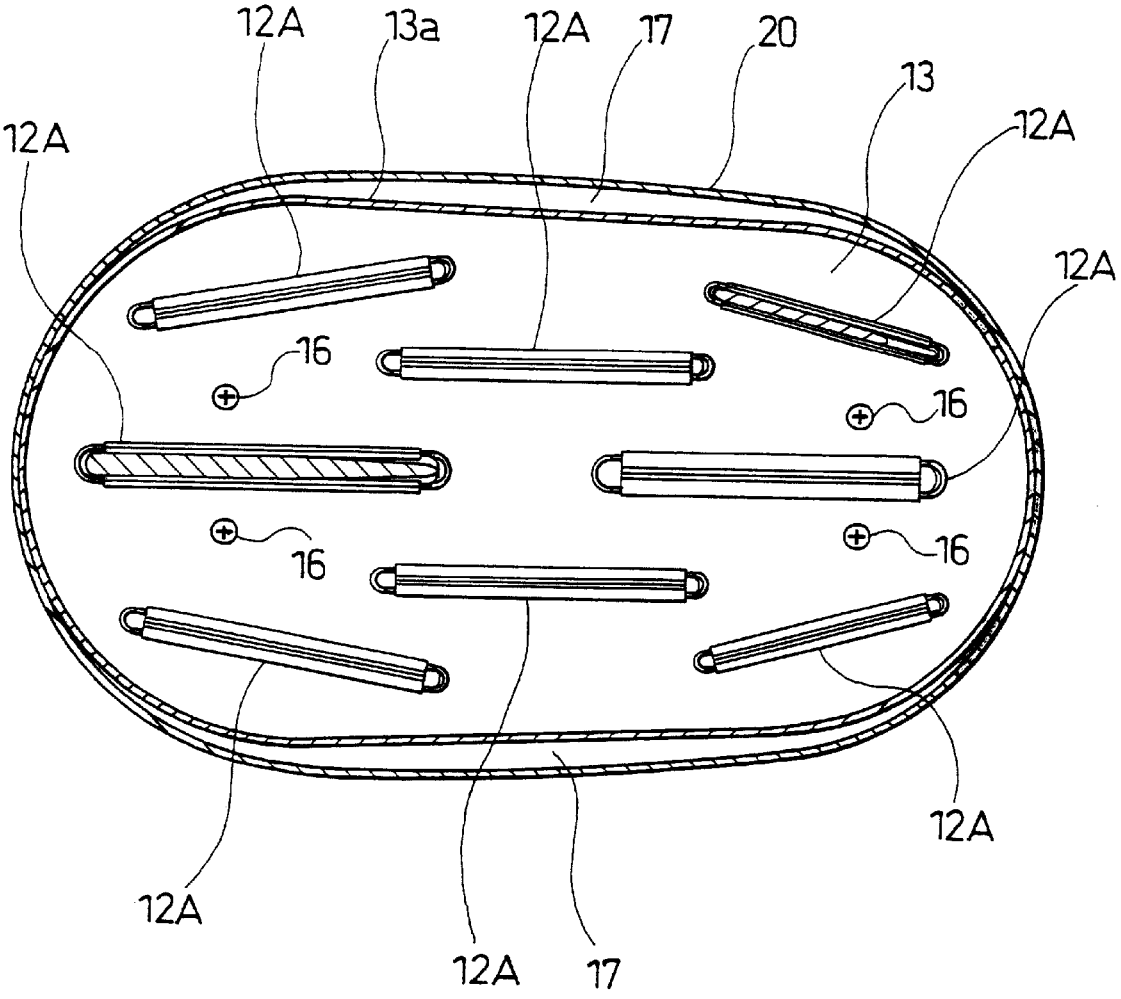
FIG. 5 indicates the inside cover part and is a cross section along the Z—Z line in FIG. 1.

FIG. 5 indicates inner state of the cover part 20. It is a cross sectional view of the knife block along the Z—Z line indicated in FIG. 1. The support plate 13 is held in the cover part 20 to form a space 17. In short, the inside surface of the cover part 20 and outside part of the support plate 13*a* are not touched throughout the circumference, but the support plate 13 presents space between the cover plate 20 at both of its sides along the longitudinal direction and thus a space 17 is generated. Accordingly, when the inside of the cover part 20 is washed, water existing between the support plate and the cap part 11 is drained off smoothly (refer to FIG. 5).

As mentioned above, the holder part 10 with respect to the embodiment of the present invention comprises the cap part 11, a plurality of the blade guides 12A, the support plate 13, and bolts 16.

Figure 6A:
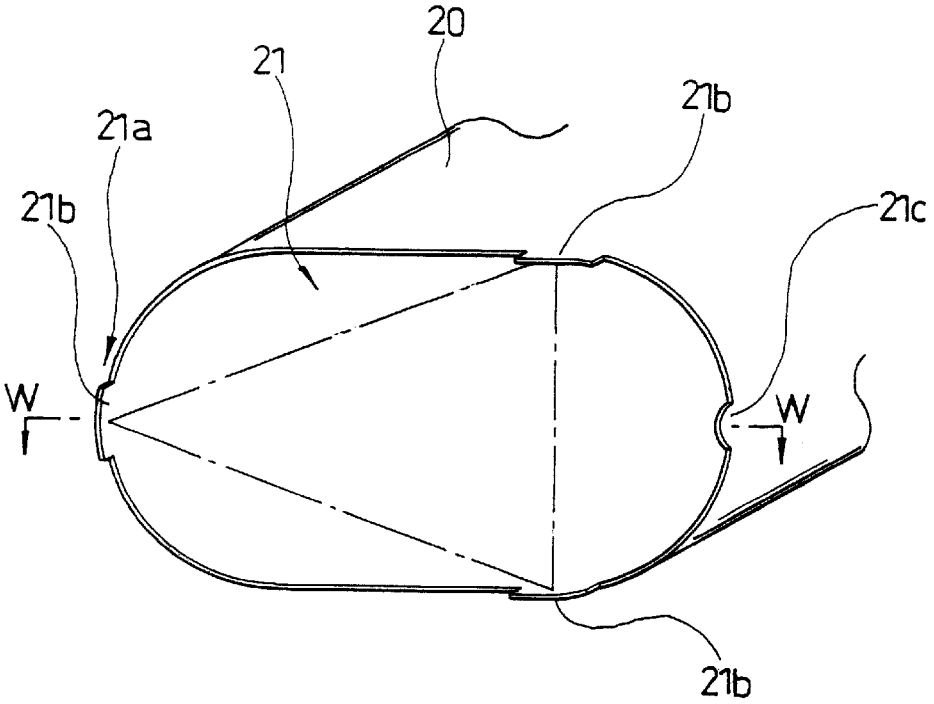
FIG. 6A is a perspective view of a lower aperture of a cover part of the present invention.
Figure 6B:
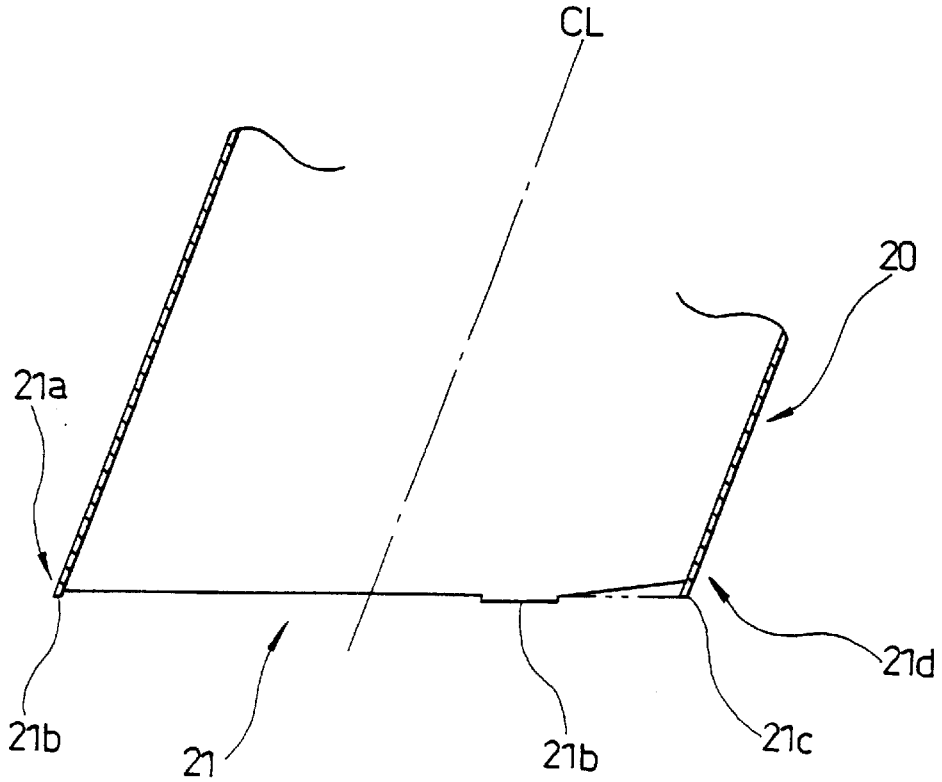
FIG. 6B is a cross-section along the W—W line in FIG. 6A.

The lower aperture of the cover part 20 is detachably fixed to the base plate 30. The structure thereof is explained with the accompanied drawings FIG. 2, FIG. 6A and FIG. 6B. FIG. 6A indicates a perspective view of the lower aperture 21 of the cover part 20. FIG. 6B is a cross section along the W—W line in FIG. 6A. The lower part of the cover part 20 is sliced off with an inclination with respect to the center line CL of the cylinder (refer to FIG. 6B). The sliced surface forms the lower aperture 21.

Meanwhile, there is formed a recessed part 31 on the base plate 30 made of hard rubber or rubber like material. The configuration of a circumferential side wall 31*a* (refer to FIG. 2) on the base plate 30 corresponds to the configuration of the lower aperture 21 of the cover part 20. Thus, the lower aperture 21 of the cover part 20 is relatively and fixedly fitted to the circumferential side wall 31*a* from the inclined direction. Due to such configuration, the lower aperture 21 is placed horizontally with respect to the surface of the base plate 30. An acute angle part 21*a* of the lower aperture is engaged with the circumferential side wall 31*a* of the recessed part 31 of the base plate 30. Now the cover part 20 stands with an inclination but it stands stably. As the base plate 30 is made of hard rubber or rubber like material, the cover part 20 is always held stably due to elastic power of the material of the base plate 30. It is also easy to take out the cover part 20 from the circumferential side wall 31*a* of the base plate 30.

There are formed protrusions 21*b* around the circumferential edge of the lower aperture 21. The three protrusions 21*b* are intended to set the cover part 20 stably on the base plate 30. It is thus required to provide said three protrusions at a position to connect them at least with a triangle configuration (refer to a dot line in FIG. 6A). In particular, when configuration of the cross section of the cover part 20 presents an ellipse configuration, one protrusion 21*b* is placed on one end of the longitudinal axis and other two protrusions 21*b* are provided at contrast positions on the circumferential edge of the lower aperture 21 with respect to the center line of the longitudinal axis of the lower aperture. It goes without saying that the configuration of the lower aperture 21 of the cover part 20 not strictly limited to a fixed ellipse configuration but other configuration such as Japanese straw shoes or cocoon are also included.

One end of said longitudinal axis of the lower aperture 21 indicates an acute angle part 21*a*. However, in the embodiment of the present invention, the other end of said longitudinal axis indicates an obtuse angle side part 21*c* as shown with two dots line in FIG. 6B.

The cover part 20 is surrounded with stainless steel plate and is welded two edges together. In the preferred embodiment of the present invention the edge to be welded is the other end of the longitudinal axis of the cover part 20. Welding is performed along the edges of the cover plate starting from the obtuse angle side part 21*c* of the lower aperture 21. When welding is performed it is required to finish the welded parts with preferable finishing treatment such as grinding or the like. If the obtuse angle side part 21*c* should not be formed, a recess is appeared at the starting position of the welding and it becomes impossible to repair the cover part 20 afterward. Formation of the obtuse angle side part 21*c* is thus desired to conceal such a recess in finishing treatment.

Next, a method to assemble the knife block 1 according to the present invention and the effect thereof are explained with the accompanied drawings FIG. 1, FIG. 2 and FIG. 4.

As shown in FIG. 2, the lower part of the knife guide 12A is relatively fitted in the insert hole 15A. As shown in FIG. 4, the flange like engagement part 12*a* formed on the upper part of the blade guide 12A is caught to the upper surface of the cap part 11.

Next, press the support plate 13 into the cover part 20. The support hole 14 of the support plate 13 is relatively fitted into the lower part of the blade guide 12A. When the support plate 13 is further pressed, the support plate 13 is reached to the preparation point indicated with the imaginary lines in FIG. 4.

When the support plate 13 is placed on the preparation point, bolts 16 are tightened. The clearance between the support plate 13 and the cap part 11 is expanded and an engagement part 12*a* of the blade guide 12A is engaged with the cap part 11. The upper end parts 12*g* are assembled to the support plate 13. The holder part 10 is completely fixed to the upper aperture of the cover part 20.

Next, fix the lower aperture 21 of the cover part 20 into the recess part 31 of the base plate 30. The cover part 20 stands upright with a predetermined pertinent inclination. The knife block is thus completed. When the knife block 1 is practically used, the base plate 10 is placed on a table. As indicated in FIG. 1, the cap part 11 stands upright with a predetermined pertinent inclination to use said knife block 1. The knives C are retained in the holder part 10 in the cap part 11. In practice, the knives C are inserted through the clearance SP of the blade guide 12A. The blade guide 12A to receive the blade part C1 is fixed to the cap part 11 and the support plate 13. The direction of the knives C to be inserted is lead by the blade guide 12A and trembling defect in leftward and rightward direction is prevented. Meanwhile, as inserting the blade part C1 a grip part C2 is engaged with the cap part 11 and stopped. In other words, the grip part C2 of the knives C is engaged with the cap part 11. In short, the grip part C2 of the knives C is engaged with the cap part 11 and it is placed between the blade guides 12A. The knives C retained as such are easily taken out when it is demanded. No drawers and no opening gate under the scullery is required. It is quite convenient to treat cooking materials.

When washing the knife block 1, it is easy to wash the cover part 20 taking out the knives C from the knife block 1 because the cover part 20 and the base plate 30 are detachable. There is a space 17 between the connecting part 13*a* of the support plate 13 and the inner surface of the cover part 20 as shown in FIG. 5. Water is easily drained out. Automatic washing machine is applied quite easily.

The inventor has explained the detail of the first embodiment of the present invention.

Figure 3B:
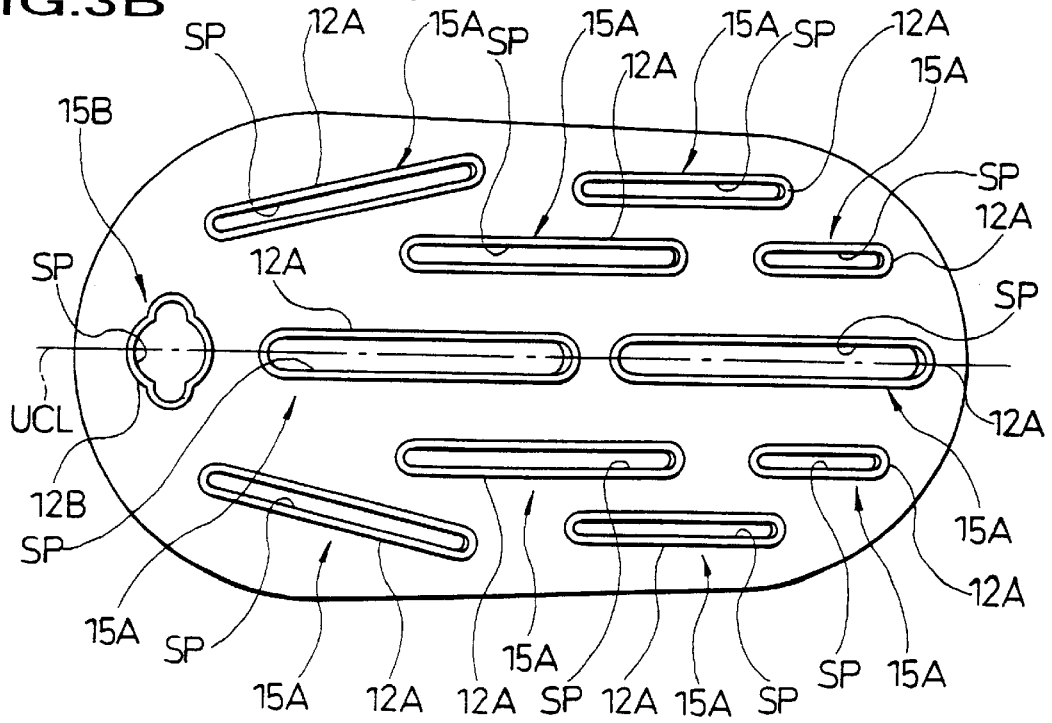
FIG. 3B indicates another aspect of the embodiments of the present invention along the direction of the arrow marked X in FIG. 1.

Next, the detail of the second embodiment of the present invention is explained. In FIG. 3B, as indicated in the first embodiment, there are provided a plurality of insert holes 15A and the blade guides 12A. In this embodiment, a file bar insert hole 15B and the blade guide 12B are provided. The insert hole 15B and the blade guide 12B comprises a clearance SP. The configuration of the clearance SP is formed such that the crossing point of the longer axis and the shorter axis of the ellipse is piled on the center of the circle. The length of the shorter axis of the ellipse is shorter than the radius of the circle configuration.

In common, grinding part of the file bar presents circle or ellipse configuration. Thus, the above configuration of the insert hole 15B and the blade guide 12B is convenient to receive a file of circle or ellipse configuration.

According to the present invention, to house a plurality of knives and taking out them quickly becomes possible. It is very convenient to use them in cooking. It is safer because the knives are guided by means of the blade guide and safely retained. Each of the knives is independently kept without touching each other. The structure of the knife block according to the present invention is simple. It is easy to manufacture.

What is claimed is:

1. A knife block comprising:

a knife guide having:

a clearance through which a blade part of a knife is inserted, wherein the knife guide guides a knife downward, a cover part surrounding the blade part of a knife, a cap part, a holder part to retain a knife by engaging a grip part of a knife, wherein the holder part is provided on an aperture of said cap part, and a base plate to secure the cover part in an upright direction with inclination.

* * * * *